US006305612B1

(12) United States Patent
Besik

(10) Patent No.: US 6,305,612 B1
(45) Date of Patent: Oct. 23, 2001

(54) COMPACT GAS FIRED HUMIDIFIER

(76) Inventor: Ferdinand K. Besik, 2562 Oshkin Crt, Mississauga, Ontario (CA), L5N 3Z3

( * ) Notice: Subject to any disclaimer, the term of this patent is extended or adjusted under 35 U.S.C. 154(b) by 0 days.

(21) Appl. No.: 09/419,577

(22) Filed: Oct. 18, 1999

Related U.S. Application Data

(63) Continuation-in-part of application No. 08/657,179, filed on Jun. 3, 1996, now abandoned.

(51) Int. Cl.[7] ..... F24F 3/14
(52) U.S. Cl. ..... 237/78 R
(58) Field of Search ..... 237/78 R, 67; 126/20.2; 122/135.3

(56) References Cited

U.S. PATENT DOCUMENTS 3,810,447 * 5/1974 Grainger ..... 122/235 R
5,161,488 * 11/1992 natter ..... 122/149
5,259,342 * 11/1993 Brady et al. ..... 122/367.1
5,368,008 * 11/1994 oslin ..... 122/135.3

* cited by examiner

*Primary Examiner*—Harold Joyce
*Assistant Examiner*—Derek S. Boles

(57) ABSTRACT

A compact fuel fired steam generating type humidifier. The apparatus uses a gaseous fuel as the source of heat to generate steam used to humidify air in heating, ventilation and air conditioning of buildings. The humidifier may be a stand alone unit that disperses the steam into the space, or the steam generated by the apparatus may be dispersed in forced air flow of the building heating system. The steam generating unit includes an insulated casing housing a dry firebox combustion chamber with the boiler immersed in the firebox chamber. The boiler has a high rate internal recirculation of the boiling water and is spaced from the interior walls of the firebox chamber providing an effective passage and contact of the hot combustion products with the vertical heat transfer surfaces of the boiler. The production of the steam from feed water is controlled by a humidistat and is maintained by automatic periodic intake of the feed water. Concentration of total solids in the boiling water is maintained by automatic periodic blowdown of the recirculating boiling water that is cooled by the incoming feed water.

19 Claims, 2 Drawing Sheets

COMPACT GAS FIRED HUMIDIFIER

CROSS-REFERENCE TO RELATED APPLICATION

This Application is a continuation-in-part of my earlier application Ser. No. 08/657,179, filed Jun. 3, 1996 now abandoned.

FIELD OF INVENTION

The present invention relates to a compact fuel fired steam generating type humidifier. The apparatus uses a gaseous fuel as the prime source of heat to generate steam used to humidify air in the heating, ventilation and air conditioning of buildings. The humidifier may be a stand alone unit that disperses the steam into the space or the steam generated by the apparatus may be dispersed in forced air flow of the building heating system.

BACKGROUND

Humidification of air is an operation concerned with an interphase transfer of mass and energy that occurs when air is brought into contact with water in which the air is essentially insoluble. Depending on whether the water is in a form of a liquid or a vapor, there are two air humidification processes: a) An adiabatic process, in which the treated air is brought into a direct contact with water and the required evaporation heat is extracted from the air that is being humidified, and b) An isothermic process, in which a water vapor at atmospheric pressure is added to the treated air to increase its moisture, in which the heat energy of the treated air is unaffected.

The isothermic humidification process is usually carried out in a central air conditioning air duct system or in an open space, by distributing and mixing of a stream of atmospheric steam with a stream of air. The amount of steam that can be added to a stream of air is limited and depends on the dry bulb temperature and the absolute moisture content of the treated air. The steam for humidifying the air may be produced either at the location of the steam distributor in a compact humidifier, or it can be delivered to the steam distributor from a central steam boiler.

Technical and commercial literature indicate, that the current art compact isothermic humidifiers are producing the atmospheric steam in a sealed water tank by boiling and evaporating the incoming feed water at atmospheric pressure in a single stage evaporation process. The required heat is provided either by electric power via two or more electrodes or electric resistance heating elements submerged in the boiling water, or by a pressure steam delivered from a central steam boiler in a submerged heat exchanger.

An electric steam generating humidifier is disclosed in U.S. Pat. No. 4,239,956 issued Dec. 16, 1980 and reissued Oct. 30, 1990 as RE 33,414. Referred to in this patent are U.S. Pat. No. 3,386,659 and U.S. Pat. No. 3,436,967 as disclosing a steam generator in combination with duct work of forced air heating system.

Disclosed in U.S. Pat. No. 4,564,746, issued Jan. 14, 1986 to B. W. Morton et. Al, is a cabinet type steam generating room humidifier.

The feed water used in compact isothermic humidifiers may be a city water, softened water, deionized water (DI) or reverse osmosis treated water (RO). Regardless of the feed water quality, all compact isothermic humidifiers are provided with a method to control the flow of the feed water into the water tank, a method to control the volume and the water level in the water tank, and a method to control the operating pressure in the water tank.

As the feed water is converted into steam, impurities which enter with feed water are concentrated in the water tank. Of concern are mainly the inorganic compounds of hard scale forming substances such as calcium and magnesium. Each substance has its own solubility limit in water solution. When its concentration exceeds the solubility limit, the excess substance precipitates and builds up a hard scale on the submerged electric resistance heating elements, electrodes, heat exchanger, and the water tank walls. The build up reduces the overall heat transfer rate. To maintain the performance and the efficiency of the humidifier, the water tank, the submerged heating elements and the heat exchanger are regularly cleaned, and the water tanks provided with the electrodes are regularly replaced at a considerable maintenance and replacement material cost.

To extend the operating period of the water tank, all isothermic humidifiers operating with feed water containing dissolved solids (DS) are provided with a method to control the concentration of total solids TS in the boiling water to reduce the hard scale build up rate. Most of them control the TS in the boiling water by a regular periodic blowdown of a mixture of feed water and boiling water which results in excessive consumption of feed water and with excessive heat loss with the blowdown water.

The steam generation process used in current art compact isothermic humidifiers involves steps including transfer of heat from the heat source into the water to cause it to boil, evaporation of the water, concentration of TS in the boiling water, separation of the produced steam from the boiling water, discharge of the produced steam from the water tank, replacement of the evaporated water with feed water, blowdown of boiling water to maintain an acceptable TS concentration in boiling water, and replacement of the blowdown water with feed water. All these process steps occur in a water tank at atmospheric pressure.

In current art compact isothermic humidifiers operating with feed water containing DS the flow of the feed water into the water tank is periodic and the steam generation process is cyclic and includes two operating periods.

The first operating period involves steps including transfer of heat from the heat source into the boiling water, evaporation of the boiling water, precipitation of DS and concentration of TS in the boiling water, separation of the produced steam from the boiling water, and discharge of the produced steam from the water tank.

The following second operating period, in addition to the above steps, involves process steps including filling up of the water tank with make up water, draining of a small portion of the boiling water, and heating of the feed water up to its boiling temperature. During the second operating period the concentration of DS and TS in the boiling water drops in proportion to the flow of the feed water. After a number of steam cycles the water tank is drained and flushed to minimize build up of the hard scale.

Because of the periodic intake of cool feed water into the water tank and use of a portion of the process heat in heating up of the feed water to boiling temperature, the rate of production of steam during the second operating period is reduced. Depending on the flow rate of feed water, temperature of the water in the water tank may fall below the boiling point. Under such conditions the steam is not produced and the treated air stream is not humidified.

All current art isothermic humidifiers use process controls to keep the process equipment and the integrated humidification and steam generation processes operating and carried out as required to maintain a preset humidity of the air being humidified. There are four groups of controls that are integrated to maintain the operation of the humidifying system fully automatic. They include: a) the humidification process controls regulating the humidification of a stream of treated air, b) the electric power and safety controls regulating the power input in response to a humidity load, or steam controls for regulating the steam input to the heat exchanger in response to a humidity load, c) the water controls regulating the flow of feed water, water level, concentration of TS, blowdown of the boiling water, and draining of the water tank, and d) the monitoring and display of selected performance parameters.

A major concern with the current art compact isothermic humidifiers are the very high operation energy cost and operation maintenance cost. The high operation energy cost is the result of use of the electric power as the source of the heat required in the production of the steam. The high operation maintenance cost is due to the required regular cleaning of the water tank and of the submerged electric resistance heating elements or heat exchanger, or the regular replacement of the water tank operating with electrodes due to the excessive build up of hard scale.

Therefore, to overcome the shortcomings of the current art humidifiers, the object of the present invention is to provide a compact apparatus that produces steam from feed water containing dissolved solids using a gaseous or a liquid fuel and at minimum capital, operating and maintenance costs.

BRIEF DESCRIPTION OF THE INVENTION

An object of the present invention is to provide a compact steam generating type humidifier that uses combustion of a gaseous or a liquid fuel in heating, recirculating, boiling, and evaporating feed water in a single stage unsteady state cyclic evaporation process carried out in a vertical boiler at atmospheric pressure.

Another aspect of the present invention is to provide a compact humidifier that will produce a continuous stream of clean atmospheric steam by combustion of fuel in a dry firebox type combustion chamber having therein a vertical boiler in which the steam is produced.

Another aspect of the present invention is to provide a compact apparatus for a continuous production of steam by combustion of a fuel in a dry firebox type vertical boiler in with the heat from the hot combustion gases is producing a high rate recirculation of the boiling water within the boiler.

Another aspect of the present invention is to provide a compact apparatus for a continuous production of steam by combustion of a fuel in a dry firebox type vertical boiler with the boiler walls in contact with the hot combustion gases having an extended heat transfer surface to increase the heat transfer rate from the hot combustion products into the recirculating boiling water.

Another aspect of the present invention is to provide a compact apparatus for a continuous production of steam from feed water containing dissolved solids at atmospheric pressure under conditions of a controlled periodic flow of feed water, a controlled variable water level of the recirculating boiling water and a controlled regular periodic blow down of the recirculated boiling water.

Another aspect of the present invention is to provide a compact apparatus for a continuous production of steam from feed water containing dissolved solids in which the precipitate, formed during the evaporation of the feed water, is formed in the recirculating boiling water preventing the build up of the hard scale on the heat transfer surfaces of the boiler.

Another aspect of the present invention is to provide a compact apparatus for a continuous production of steam from feed water containing dissolved solids in which the concentration of the precipitate in the recirculated boiling water is maintained at the desired level by a controlled regular periodic blow down of the recirculating boiling water.

Another aspect of the present invention is to provide a compact apparatus for a continuous production of steam from feed water containing dissolved solids in which the heat from the blow down boiling water is recovered and used in preheating of the feed water.

Another aspect of the present invention is mixing of the cooled combustion products with dilution air to lower their dew point to eliminate condensation of moisture in the flues ducting.

These and other features and advantages of this invention will become apparent upon reading the following specification, which along with the drawings describes and discloses preferred embodiments of the invention in detail.

The detailed description of the specific embodiments makes reference to the accompanying drawings which illustrate, in schematic form, the present invention and its interface with a typical forced air heating ventilation and air-conditioning system.

BRIEF DESCRIPTION OF DRAWINGS

The invention is illustrated by way of example with reference to the accompanying drawings wherein.

DETAIL DESCRIPTION OF PREFERRED EMBODIMENTS

Figure 1:
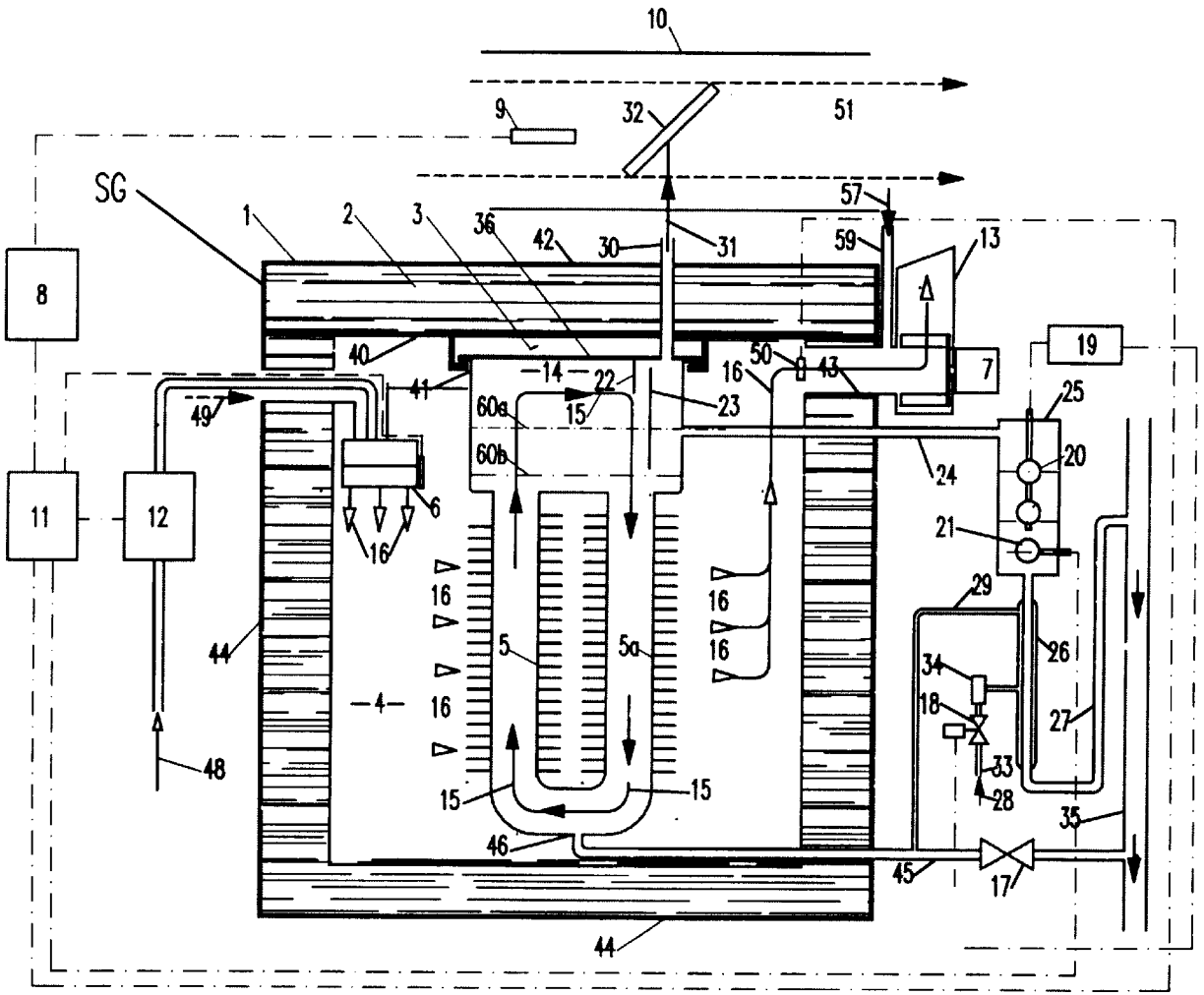
FIG. 1 is a schematic illustration of the preferred embodiment of the compact humidifier of the present invention intended for use in heating, ventilation and air conditioning of buildings for humidification of air.
Figure 3:
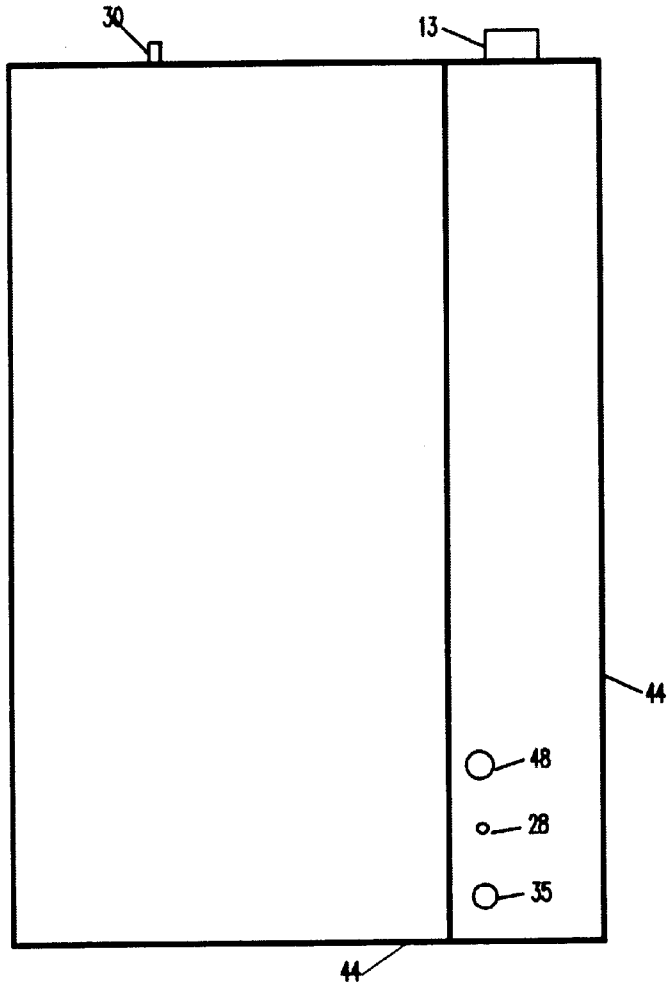
FIG. 3 is an elevation view diagrammatically illustrating the compact steam producing apparatus of FIG. 1 and FIG. 2.

Schematically illustrated in FIG. 1, is a humidifying system comprising compact steam generating device SG of the present invention that provides steam 31 to a steam distributor 32 located in an air duct 10 of a building forced air system. Various arrangements for a duct and steam injector system are known some of which are illustrated in the aforementioned patent RE 33,414 and thus are not further described herein.

The device SG has a casing 1 provided with thermal insulation 2 and a boiler 3 immersed in a dry firebox combustion chamber 4.

The boiler 3 is a sealed flanged type unit designed to operate at atmospheric pressure. It includes a steam separation chamber 14, at lest a single pair of vertical fin tubes 5, 5*a* with their open top ends connected to the steam chamber 14. The pair of fin tubes is provided for transferring of the heat from the hot combustion products to the boiling water and for recirculating the boiling water in the boiler 3 as illustrated by arrows 15.

The steam chamber is provided with partitions 22 and 23 to separate the produced steam from the recirculating boiling water and to direct the recirculating water to the downflow fin tube 5*a* and through the upflow fin tube 5 back into the steam chamber 14.

A conduit 30 is provided for discharge of the produced steam and conduit 24 for the blow down of the boiling water and container 25 provided with a high-low water level controller 20 and a water level safety controller 21 for controlling the water level in boiler 3. A water to water heat exchanger 26 is provided to transfer the heat from the blow down boiling water to the incoming feed water and a water seal 27 is provided to pressure seal the boiler 3.

A dry firebox chamber 4 includes a burner 6 provided for combustion of a gaseous or a liquid fuel therein to generate the heat required by the boiler to produce the steam. The firebox chamber includes side and bottom walls 44 provided with thermal insulation 2 to prevent heat loss from the hot combustion products 16 and a top wall 40 with opening 41 is provided for immersion of the boiler 3 into the dry firebox chamber 4. The dry firebox 4 is provided with an opening 43 for the exit of the cooled combustion products drawn by the exhaust fan 7 and with an insulated cover 42 to prevent heat loss from the dry fire box top wall 40.

The boiler flange 36 closes the opening 41 in the top wall 40 of the dry firebox chamber 4 immersing the boiler 3 into the dry firebox chamber. The fin tubes 5, 5*a* are closely spaced from the side walls of the dry firebox chamber so that the space between the fins of the fin tubes 5, 5*a* provides the effective horizontal flow path for the hot combustion products 16 passing through the dry firebox chamber.

The major portion of the available heat in the hot combustion products 16 passing through the dry firebox chamber 4 is transferred through the wall of the fin tube 5 into the water therein, causing the water to evaporate in small bubbles formed on the internal surface of the fin tube wall. The remainder of the useful heat is then transferred through the wall of the fin tube 5*a* causing the water to evaporate in small bubbles therein. The resulting density of the mixture of steam bubbles and the boiling water in tubes 5 and 5*a* depends on the volume of steam bubbles in the boiling water in each tube and is indirectly proportional to the amount of heat transferred through each fin tube wall. Since the amount of heat transferred from hot combustion products through the fin tube 5 to boiling water is much larger then that transferred from the partially cooled combustion products through the fin tube 5*a*, the density of the mixture of steam bubbles and boiling water in tube 5 is much lower than that in tube 5*a*, causing the water to recirculate in the direction of arrows 15. The recirculation rate is directly proportional to the tubes hight and the difference in the amount of heat transferred through the fin tubes 5 and 5*a*. With the increased recirculation rate of the boiling water the overall heat transfer rate increases and the formed precipitated solids are maintained in suspension in the recirculated boiling water. With recirculation of the suspended solids with the recirculating water, formation of the hard scale on the heat transfer surfaces of the boiler is minimized and the high overall heat transfer rate is maintained.

To maintain the concentration of the precipitated solids in the recirculated boiling water at the desirable level, portion of the boiling water is regularly blown down at a controlled rate through the heat exchanger 26 and water seal 27 to drain 35. The heat exchanger 26 is provided for the recovery of the waste heat from the blow down boiling water to cool the boiling water before its discharge to a sewer.

A conduit 27 provides a water seal for the boiler and serves to blow down the cooled boiling water to drain 35.

The feed water 28 flows through the water pipe 33, solenoid valve 18, flow restrictor 34, heat exchanger 26 container 25, conduits 29, 45 and inlet 46 into the boiler 3. The flow restrictor 34 provides the required constant flow rate of the feed water. The water level in the boiler 3 is maintained between the high level 60*a* and the low level 60*b* by the water level controller 20 located in the container 25 in combination with a variable time delay relay 19 and solenoid valve 18.

The water level controller 20 and the variable time delay relay 19 with the solenoid valve 18, and restrictor 34 maintain the required periodic flow of the incoming feed water and the controlled periodic blow down of the boiling water to produce the required atmospheric steam and to maintain the desirable concenration of the suspended solids in the recirculating boiling water in the boiler. A safety switch 21 is provided to shut down the operation of the apparatus when the water level in container 25 for some reason falls to the level of the safety switch 21. A manual drain valve 17 is provided for the seasonal draining of the boiler 3 via conduit 40 and drain 35 to a sewer.

There is an induced draft combustion system controlled by a combustion controller 11 that includes a gas valve 12, a burner 6, and an exhaust fan 7. A gaseous fuel 48 mixes with combustion air 49 drawn into the burner 6 by the exhaust fan 7. Combustion of fuel is carried out in the dry firebox chamber 4 constructed of metal walls 44 provided with thermal insulation 2 to minimize the casing heat loss. Dilution air 57 is drawn through pipe 59 into the exhaust fan 7 to mix the dilution air 57 with the flues to lower the flue's dew point to eliminate condensation of moisture in the flues ducting 13. For higher combustion efficiency one may use a conventional modulating constant air/fuel ratio valve train (not shown in FIG. 1). A forced air combustion system replacing the described induced draft combustion system may be also used.

The humidistat 8 with a sensor 9 controls the consumption of steam in air duct 10 by controlling the operation of the induced draft combustion system. Depending on the conditions, the humidistat 8 may be either of an ON-OFF type for controlling a periodic humidification process, or a modulating humidistat for controlling a continuous humidification process. Depending on the type of the humidistat, the gas valve 12 may be an ON-OFF type solenoid valve for use with an ON-OFF type humidistat or a proportional or a modulating gas valve when using a modulating humidistat.

The steam boiler 3 is protected against overheating by a high temperature limit control switch 50 located in the intake of the exhaust fan 7 connected to the combustion controller 11 to deactivate the system upon reaching an overheat situation.

It can be appreciated, that if desired, the described gaseous fuel may be conveniently replaced by a liquid fuel to achieve the same result and that a monitor, including sensors, processors, clock, timer, and displays may be provided to monitor and display the performance and operation of the humidifying system.

While the described embodiment uses a single pair of the boiler fin tubes 5 and 5*a*, it can be appreciated by those with skills in the art, that there may be more than one pair of fin tubes 5, 5*a* and that the fin tubes may be arranged in a series or in a parallel configurations, or that the fin tubes may be replaced with vertical heat transfer surfaces of different shape to achieve the same results and the desired capacity or the desired physical shape of the compact steam generating humidifier.

While the described embodiment uses the conduit 27 as a water seal to protect the boiler against an increase in the operating pressure, it can be appreciated that the conduit 27 may be conveniently provided with a conventional closing valve controlled by the variable time delay relay 19 to permit the production of the steam in the boiler at a desired elevated pressure and that the production of the steam may be also controlled by a conventional thermostat or a conventional steam flow regulator.

Operation of the described embodiment of the present invention, when controlled by a modulating humidistat, is as follows.

The modulating humidistat 8 continuously monitors the humidity load demand of the air 51 in the air duct 10 and trough the combustion controller 11 regulates the operation of the gas valve 12 and burner 6.

The combustion air 49 is drawn into the burner by the exhaust fan 7. Combustion of the gaseous fuel 48 with combustion air 49 occurs at the burner 6 in the dry firebox combustion chamber 4. Combustion of the fuel produces the heat required for heating the preheated feed water 28 to boiling temperature, for the production of the required amount of steam 31 to be added to the air stream 51 in the air duct 10 through the steam distributor 32 and to provide the recirculation of the boiling water within the boiler to increase the overall heat transfer rate and to maintain the formed precipitate in suspension in the recirculated. boiling water.

The required process heat is recovered and transferred from the hot combustion gases 16 passing through the dry firebox chamber 4 through the fin tubes 5, 5*a* to the recirculating boiling water causing it to evaporate in small steam bubbles and recirculate as shown by arrows 15 upwardly through the fin tube 5 and downwardly through the fin tube 5*a*. The flue gases cool as they are drawn through the dry firebox chamber 4 by the exhaust fan 7 and are discharged via the duct 13 to outdoors.

The steam for the humidification is produced in a cyclic unsteady state boiling process controlled by the modulating humidistat and carried out in the boiler 3 at atmospheric pressure in two operating periods.

The first operating period involves process steps of a continuous unsteady state combustion of fuel, transfer of heat from combustion gases through the fin tube wall to a recirculating boiling water, formation of small steam bubbles in the recirculating boiling water, separation of the steam bubbles from the recirculating boiling water, precipitation of the dissolved solids present in the recirculating boiling water, discharge of the produced steam out of the boiler and discharge of the cooled combustion products out of the dry firebox chamber to outdoors.

As the recirculating boiling water in the boiler 3 evaporates and the atmospheric steam is delivered to the steam distributor 32, concentration of the total solids (TS) in the recirculated boiling water rises and the water level in the boiler slowly drops from the high water level point 60*a* to the low point 60*b*. When the water level drops to the low point 60*b*, the water level float switch 20 opens the feed water solenoid valve 18 to provide the required controlled flow of feed water through the flow restrictor 34 the heat exchanger 26 container 25, conduits 29 and 45 into the boiler 3. Opening of the feed water solenoid valve starts the longer second operating period of the steam generation cycle.

The second operating period involves the process steps of a steady state flow of incoming feed water, a continuous unsteady state combustion of fuel and transfer of heat from the hot combustion products through the fin tube wall to the recirculating boiling water, formation of small steam bubbles in the recirculating boiling water, dilution of the dissolved and precipitated solids in the recirculating boiling water, separation of the steam bubbles from the recirculating boiling water, discharge of the produced steam out of the boiler, blow down of the recirculating boiling water, transfer of heat from the hot blow down boiling water to the incoming feed water and discharge of the cooled blow down to a sewer and the cooled combustion products to outdoors.

During the second operating period the heat transferred from the hot combustion products through the fin tube wall to the recirculating boiling water is used to heat the preheated feed water to boiling temperature and to evaporate the boiling water to produce the required steam.

With the incoming feed water the water level in the boiler rises from the low water level 60*b* to the high water level 60*a*. When the water level in the boiler reaches the higher water level point 60*a*, the water level controller 20 activates the variable time delay relay 19 which after the preset time delay interval closes the feed water solenoid valve 18. During the preset time delay interval the incoming feed water causes the recirculated boiling water to overflow from the steam chamber 14 through the conduit 24, heat exchanger 26 and conduit 27 to drain 35. The blow down boiling water is drained at a constant rate providing the required blow down of the precipitated solids to maintain the concentration of the suspended solids in the recirculating boiling water at a preset concentration level. Closing of the feed water solenoid valve 18 completes the second operating period and starts a new steam generation cycle. The blow down rate depends and increases with the concentration of total solids and hardness of feed water.

Regardless of the quality of the feed water, the apparatus of the present invention offers a substantially increased overall heat transfer rate and a smaller physical size. It also minimizes the build up of the hard scale on the heat transfer surfaces of the boiler and recovers the waste heat from the blow down boiling water.

Figure 2:
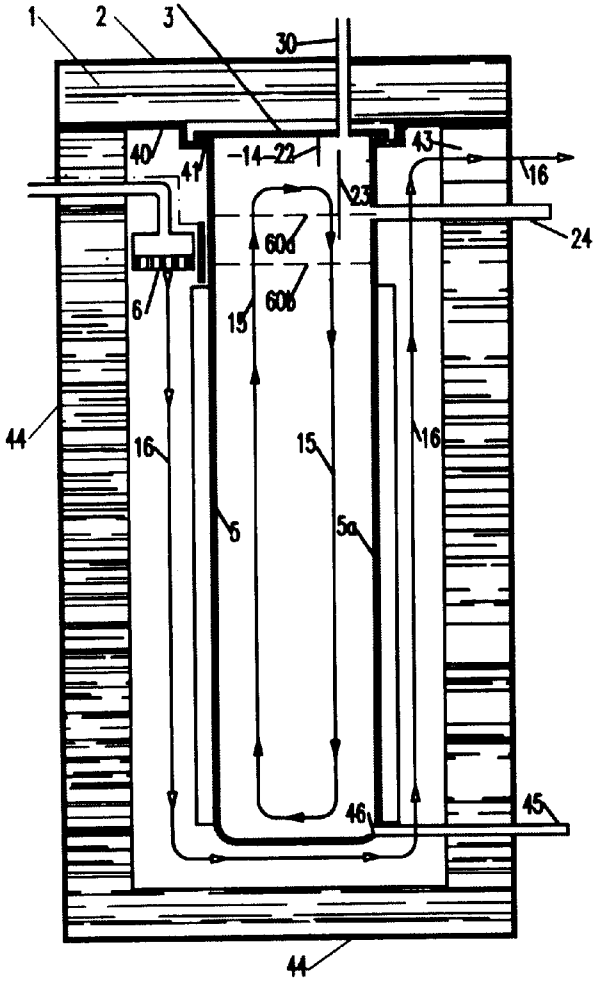
FIG. 2 is a schematic illustration of another preferred embodiment of the compact humidifier of the present invention intended for use in humidification of air.

FIG. 2, is a schematic illustration of another preferred embodiment of the compact humidifier of the present invention in which the fin tubes 5, 5*a* are replaced with two opposite side walls 5, 5*a* of a vertical water tank boiler 3. The two side walls 5, 5*a* are provided with vertical fins to increase the heat transfer surface on the gas side of the boiler. The space between the fins of the vertical walls 5, 5*a* and the walls of the dry firebox chamber 4 provide a vertical passage way for the hot combustion products 16 passing through the dry firebox chamber 4.

The major portion of the available heat in the hot combustion products 16 passing through the dry firebox chamber 4 is transferred through the vertical wall 5 into the water in contact with the vertical wall causing it to evaporate in small steam bubbles formed on the surface of the vertical wall 5. The remainder of the useful heat is then transferred through the vertical wall 5*a* causing the water to evaporate in small bubbles thereon. The resulting density of the mixture of steam bubbles and the boiling water in the boundaries of the vertical walls 5 and 5*a* is same as that described on the vertical walls of the fin tubes 5, 5*a* of the preferred embodiment of FIG. 1. As a result, the difference in the specific density of the mixtures of steam bubbles and boiling water in the boundaries of the vertical walls 5 and 5*a* cause the water to circulate within the boiler in the direction shown by the arrows 15. Again, the recirculation rate is directly proportional to the hight of the vertical walls 5, 5*a* and to the amount of heat transferred through the vertical walls 5, 5*a*. With the increased internal recirculation of the boiling water within the boiler the overall heat transfer rate is increased and the formed precipitate is maintained in suspension in the recirculated boiling water. The remaining features and the operation of the apparatus of the embodiment of FIG. 2 are the same as those described under the embodiment of FIG. 1.

While the preferred embodiment has been described with a feed water containing dissolved solids, it can be appreciated that the apparatus of the present invention can also operate effectively with a deionized or a reverse osmosis water.

SUMMARY OF THE DISCLOSURE

In summary of this disclosure, the present invention provides a compact gas fired humidifier for use in heating, ventilation and air conditioning of buildings for humidification of air. The apparatus is simple, compact, highly reliable, operates quietly at atmospheric pressure, is maintenance free, and uses high combustion and overall thermal efficiencies.

The apparatus uses a gaseous or a liquid fuel as the source of heat required for production of steam from feed water containing dissolved solids. Combustion of the fuel is carried out in a dry firebox combustion chamber and the heat from the hot combustion products is transferred into a boiler with a high internal recirculation of boiling water that is immersed in a dry firebox chamber. The steam is produced in an unsteady state cyclic steam generation process carried out in the boiler at atmospheric pressure. The boiler is provided with vertical heat transfer surfaces with extended heat transfer area on the gas side to increase the heat transfer rate from the hot combustion products to the boiler walls and to maintain the internal recirculation of the boiler's boiling water and the formed precipitate in suspension.

Concentration of the suspended solids in the recirculated boiling water is maintained within a preset concentration range by regular periodic blowdown of the recirculating boiling water through a heat exchanger to cool the hot blowdown boiling water by the incoming feed water.

Suitable controls are provided to maintain the operation of the apparatus and the production of steam at a required rate unattended and substantially maintenance free.

The disclosed apparatus can also operate at elevated pressure to produce pressure steam and can be applied to a number of different uses in heating, ventilation and air conditioning of residential, commercial, industrial and institutional buildings and industrial processes requiring clean atmospheric or pressure steam.

While the present invention has been described with reference to specific embodiments and in specific applications to demonstrate the features and advantages of the invented apparatus, such specific embodiments are susceptible to modifications to fit other configurations or other applications. Accordingly, the forgoing description is not to be construed in a limiting sense.

What is claimed is:

1. A compact apparatus for production of steam for use in heating, ventilation and air conditioning of buildings and in industrial processes requiring clean steam, said apparatus including:

a) combustion means provided for generating heat by combustion of a fuel with combustion air, said combustionmeans including combustion control means, gas valve means, fuel burner means, dry firebox chamber means, flue gas discharge means and high temperature limit control means, said combustion control means being provided for regulation of said gas valve means and safe operation of said burner means, said fuel burner means being provided for burning of said fuel in said firebox chamber means, said firebox chamber means provided for combustion of said fuel with combustion air to generate hot combustion gases to provide the required process heat, said firebox chamber means including (insulated) walls defining an open (top) cavity having interior side and bottom wall surface, said flue gas discharge means provided for discharging of said (cooled) combustion gases out of said firebox chamber means to outdoors, and said high temperature limit control means provided for protecting said flue gas discharge means against overheating by said combustion gases.

b) boiler means including steam chamber means integrated with vertical boiling means, said boiler means (located in said cavity and closing the open top of) integrated with said firebox chamber means having (spaced from selected ones of said cavity) extended heat transfer surfaces, said extended heat transfer surfaces having spacing providing an air flow passage for said hot combustion gases from said burner means through said firebox chamber means to said flue gas discharge means, said steam chamber means including partition means for separating steam bubbles from recirculating boiling water therein and having an outlet therefrom for discharge of said separated steam and an outlet for blow down of said recirculating water, said vertical boiling means provided (with heat transfer surface means) for transferring said process heat from said hot combustion gases to said recirculating water therein and boiling said recirculating water therein to produce said steam bubbles therein and to recirculate the boiling water therein to maintain the formed precipitate in suspension in said recirculating boiling water, said boiler means having an inlet for feed water for production of said steam discharged from said steam chamber means and for said blowdown of said recirculated water, c) feed water means provided for supplying said feed water to said boiler means interconnected with a high and low water level sensing means for controlling the flow of said feed water and for maintaining the water level in said boiler means within a present high and low water level limits, d) variable time relay means automatic periodic blow down of said recirculating water from said boiler means to maintain the concentration of suspended solids in said recirculating water at predetermined concentration.

e) conduit means for pressure sealing said boiler means and for discharge of said periodic blow down of said recirculating water to sewer means, and f) plumbing means provided for an intake of said feed water into said boiler means, for an intake of said fuel into said combustion means and for draining of said boiler means to sewer means.

2. Apparatus of claim 1 with said feed water means including restrictor means for controlling the flow rate of said incoming feed water, feed water solenoid valve means interconnected with said high and low water level sensing means for controlling the flow of said feed water and for maintaining automatic periodic operation of said feed water solenoid valve and for maintaining the water level in said boiler means within a preset high and low water level limits.

3. Apparatus of claim 1 including in addition heat exchanger means for recovery of waste heat and cooling said blow down water with said incoming feed water.

4. Apparatus of claim 2 including in addition heat exchanger means for recovery of waste heat and cooling said blow down water.

5. Apparatus of claim 2 including a steam distribution means for distribution of steam produced in said boiler means into a stream of air, means connecting said steam distributor to said boiler steam outlet and humidistat means for controlling the production of steam, said combustion control means being operatively interrelated with said humidistat means.

6. Apparatus of claim 5 wherein said humidistat means includes a modulating type humidistat for controlling of the production of steam, wherein the fuel is gas and wherein said valve means is a proportional gas valve.

7. Apparatus of claim 1 with said boiler means including vertical boiling means comprising at least a single pair of fin tube means provided for transferring the heat from said combustion products to said recirculating boiling water therein to produce said steam bubbles therein, said fin tube means being immersed in said firebox chamber means for providing a horizontal flow passage for said combustion gases from said burner means through said firebox chamber means to said exhaust means, with said feed water means including restrictor means for controlling the flow rate of said incoming feed water, feed water solenoid valve means interconnected with said high and low water level sensing means for controlling the flow of said feed water and for maintaining automatic periodic operation of said feed water solenoid valve and for maintaining the water level in said boiler means within a preset high and low water level limits.

8. Apparatus of claim 7 including in addition heat exchanger means for recovery of waste heat and cooling said blow down water.

9. Apparatus of claim 7 including a steam distribution means for distribution of steam produced in said boiler means into a stream of air, means connecting said steam distributor to said boiler steam outlet and humidistat means for controlling the production of steam, said combustion control means being operatively interrelated with said humidistat means.

10. Apparatus of claim 8 including a steam distribution means for distribution of steam produced in said boiler means into a stream of air, means connecting said steam distributor to said boiler steam outlet and humidistat means for controlling the production of steam, said combustion control means being operatively interrelated with said humidistat means.

11. Apparatus of claim 1 with said boiler means including (vertical) boiling means comprising a (vertical) water tank means integrated with said combustion chamber means (with two opposite sides of) said (vertical) water tank means being provided with (extended) heat transfer surface and (providing) a (vertical) flow passage way for said hot combustion gases from said burner means through said firebox chamber means to said exhaust means and transferring said process heat from said hot combustion gases to said (two opposite sides of said vertical) water tank means for producing said steam bubbles on said (two opposite) internal sides of said (vertical) water tank means and recirculating the boiling water in said (vertical) water tank means, with said feed water solenoid valve means interconnected with said high and low water level sensing means for controlling the flow of said feed water and for maintaining automatic periodic operation of said feed water solenoid valve and for maintaining the water level in said boiler means within a present high and low water level limits.

12. Apparatus of claim 11 including in addition heat exchanger means for recovery of waste heat and cooling said blow down water.

13. Apparatus of claim 11 including a steam distribution means for distribution of steam produced in said boiler means into a stream of air, means connecting said steam distributor to said boiler steam outlet and humidistat means for controlling the production of steam, said combustion control means being operatively interrelated with said humidistat means.

14. Apparatus of claim 12 including a steam distribution means for distribution of steam produced in said boiler means into a stream of air, means connecting said steam distributor to said boiler steam outlet and humidistat means for controlling the production of steam, said combustion control means being operatively interrelated with said humidistat means.

15. Apparatus of claim 1 with said conduit means including in addition closing valve means controlled by said variable timer means for operating said boiler means at a desired elevated pressure.

16. Apparatus of claim 1 with said vertical boiling means comprising at least a single pair of fin tube means provided for transferring the heat from said combustion products to said recirculating boiling water therein, said fin tube means being immersed in said firebox chamber means for providing a horizontal flow passage for said combustion gases from said burner means through said firebox chamber means to said exhaust means, with said conduit means including in addition closing valve means controlled by said variable timer means for operating said boiler means to produce pressure steam.

17. Apparatus of claim 16 including thermostat means for controlling the production of said pressure steam, said thermostat means being operatively interrelated with said combustion control means.

18. Apparatus of claim 16 including steam flow regulator means for controlling the production of said pressure steam, said steam flow regulator means being operatively interrelated with said combustion control means.

19. Apparatus of claim 16 including humidistat means for controlling the production of said pressure steam, said humidistat means being operatively interrelated with said combustion control means.

* * * * *